US006997768B2

(12) United States Patent
Park

(10) Patent No.: US 6,997,768 B2
(45) Date of Patent: Feb. 14, 2006

(54) FLAT LUMINESCENCE LAMP AND METHOD FOR MANUFACTURING THE SAME

(75) Inventor: Hong Bae Park, Daejon-Kwangyokshi (KR)

(73) Assignees: LG.Philips LCD Co., Ltd., Seoul (KR); SangNong Enterprises Co., Ltd., Seoul (KR); Young-Jong Lee, Daejon-Kwangkokshi (KR)

( * ) Notice: Subject to any disclaimer, the term of this patent is extended or adjusted under 35 U.S.C. 154(b) by 92 days.

(21) Appl. No.: 10/464,559

(22) Filed: Jun. 19, 2003

(65) Prior Publication Data

US 2004/0212308 A1 Oct. 28, 2004

Related U.S. Application Data

(62) Division of application No. 09/919,798, filed on Aug. 2, 2001, now Pat. No. 6,744,195.

(30) Foreign Application Priority Data

Dec. 22, 2000 (KR) ..... 10-2000-0080210

(51) Int. Cl.
*H01J 9/04* (2006.01)
*H01J 9/24* (2006.01)
*H01J 17/49* (2006.01)

(52) U.S. Cl. ..... 445/46; 445/24; 313/582; 313/584

(58) Field of Classification Search ..... 445/24, 445/25, 33, 35, 46, 49–52, 58; 216/18; 313/491, 313/483, 582, 583
See application file for complete search history.

(56) References Cited

U.S. PATENT DOCUMENTS

| | | | | |
|---|---|---|---|---|
| 4,270,823 | A | 6/1981 | Kuznetzoff | 316/19 |
| 4,518,894 | A | 5/1985 | Andreadakis | 313/491 |
| 5,607,718 | A * | 3/1997 | Sasaki et al. | 438/584 |
| 5,800,232 | A * | 9/1998 | Miyazaki | 445/24 |
| 6,005,345 | A | 12/1999 | Choi et al. | 313/582 |
| 6,034,470 | A * | 3/2000 | Vollkommer et al. | 313/485 |
| 6,068,879 | A * | 5/2000 | Pasch | 216/18 |
| 6,264,851 | B1 * | 7/2001 | Markovich et al. | 216/39 |

* cited by examiner

*Primary Examiner*—Nimeshkumar D. Patel
*Assistant Examiner*—Matt Hodges
(74) *Attorney, Agent, or Firm*—Morgan, Lewis & Bockius LLP

(57) ABSTRACT

A flat luminescent lamp and a method for manufacturing the same are disclosed in the present invention. More specifically, a flat luminescent lamp includes first and second substrates each having a plurality of grooves in sides which the first and second substrates face into each other, first and second electrodes in the grooves, first and second phosphor layers in the first and second substrates including the first and second electrodes, respectively, and a frame for sealing the first and second substrates.

12 Claims, 9 Drawing Sheets

FLAT LUMINESCENCE LAMP AND METHOD FOR MANUFACTURING THE SAME

This is a divisional of application Ser. No. 09/919,798 filed on Aug. 2, 2001 now U.S. Pat. No. 6,744,195.

This application claims the benefit of Korean Application No. 10-2000-80210 filed on Dec. 22, 2000, which is hereby incorporated by reference.

BACKGROUND OF THE INVENTION

1. Field of the Invention

The present invention relates to a flat panel display device, and more particularly, to a flat luminescence lamp and method for manufacturing the same. Although the present invention is suitable for a wide scope of applications, it is particularly suitable for reducing size of the lamp, thereby enhancing luminescence.

2. Discussion of the Related Art

An ultra thin flat panel display device has a display screen with a thickness of several centimeters. Especially, liquid crystal display (LCD) devices among the flat panel display device are widely used for monitors of notebook computers, spacecrafts, and aircrafts.

Of such LCDs, a passive luminescence LCD device has a backlight attached at the rear side of a liquid crystal panel and used as a light source. However, the backlight is generally inefficient in terms of weight, power consumption, and thickness.

The backlight used as a light source of an LCD is formed in such a manner that a cylindrical fluorescent lamp is arranged thereon. The backlight includes a direct type and a light-guiding plate type.

In the direct type backlight, a fluorescent lamp is mounted on a flat panel. Since a shape of the fluorescent lamp is displayed on a liquid crystal panel, it is necessary to maintain a certain distance between the fluorescent lamp and the liquid crystal panel and arrange a light-scattering means for a uniform light distribution. In this case, there is a limitation in forming a thin sized backlight.

Due to a trend of a large sized panel, a light-emitting area of the backlight increases. If the direct type backlight has a large area, the light-scattering means should have a sufficient thickness to make the light-emitting area flat. In this case, there is also a limitation in forming a thin sized backlight.

In the light-guiding plate type, a fluorescent lamp is mounted outside the flat panel so that light is dispersed in all sides using a light-guiding plate. In this case, since the fluorescent lamp is mounted at the side and light should pass through the light-guiding plate, a problem arises in that luminance is low. Also, for a uniform distribution of luminous intensity, an advanced optical design and processing technologies are required.

Currently, for high luminance, a direct type backlight has been proposed in which a number of lamps are arranged below the display surface or a lamp is arranged in a bent shape. Further, a flat luminescent backlight having a flat surface facing into the display surface of the panel, thereby illuminating from the entire surface has been researched and developed. This type of the flat luminescent backlight is disclosed in the U.S. Pat. No. 6,034,470.

A related art flat luminescent lamp will be described with reference to the accompanying drawings.

FIG. 1 is a plane view illustrating a related art flat luminescent lamp, and FIG. 2 is a cross-sectional view taken along the line II—II of FIG. 1.

As shown in FIG. 1, the related art flat luminescent lamp includes a lower substrate 11, an upper substrate 11*a*, cathodes 13 formed on the lower substrate 11, anodes 13*a* formed on the upper substrate 11*a*, four frames 19*a*, 19*b*, 19*c*, and 19*d* for sealing the lower and upper substrates 11*a* and 11 by a soldering such as a glass solder, and a plurality of support rods 21 formed between the lower and upper substrates 11 and 11*a*.

More specifically, the anodes 13*a* are formed in pairs at constant intervals. The cathodes 13 are formed on the corresponding lower substrate 11 between the anodes 13*a*. The cathodes 13 and the anodes 13*a* are coated with a dielectric material, and an external voltage is applied to the cathodes 13 and the anodes 13*a* through a lead line.

Surfaces of the upper and lower substrates 11*a* and 11 facing into a discharge space are coated with a fluorescent material. In the discharge space, a Xe gas inducing discharge forms plasma and emits ultraviolet rays (UV). The emitted UV comes into collision with the fluorescent material on the upper and lower substrates 11*a* and 11. For this reason, the UV is excited to generate visible rays.

Additionally, a reflecting plate 14 (shown in FIG. 2) is further provided over the lower substrate 11. The reflecting plate 14 serves to prevent the visible rays generated in the discharge space from leaking out to the rear side of the lower substrate 11. The support rods 21 are made of a glass material so as not to interrupt emission of the visible rays.

Referring to FIG. 2, the cathodes 13 are formed on the lower substrate 11 of a glass material. A first dielectric material layer 12 is formed on the lower substrate 11 including the cathodes 13. The reflecting plate 14 is formed on the first dielectric material layer 12 and a first phosphor layer 15 is formed on the reflecting plate 14. The anodes 13*a* that induce discharge together with the cathodes 13 are formed on the upper substrate 11*a* of a glass material.

A second dielectric material layer 12*a* is formed on the upper substrate 11*a* including the anodes 13*a*. A second phosphor layer 15*a* is formed on the second dielectric material layer 12*a*. On the upper and lower substrates 11*a* and 11, frames 19*a*, 19*b*, 19*c*, and 19*d* are formed thereon to seal the upper and lower substrates 11*a* and 11 by a glass solder. It is well known that the cathodes 13 and the anodes 13*a* are formed by silk printing or a vapor deposition process.

In the aforementioned related art flat luminescent lamp, if a voltage is applied to the cathodes 13 and the anodes 13*a* through a lead line, a Xe gas forms plasma in the discharge space between the cathodes 13 and the anodes 13*a*, thereby emitting UV. In this process, the UV comes into collision with the first and second phosphor layers 15 and 15*a* to generate visible rays, so that the UV is emitted.

However, the related art flat luminescent lamp has several problems as follows.

Since the cathodes and the anodes are formed by silk printing or a vapor deposition process, there is a limitation in reducing the widths of the cathodes and the anodes at 0.2 mm (a minimum value) or below. Accordingly, luminous uniformity of the light-emitting area is deteriorated due to obscure rays near the cathodes and the anodes and discontinuity in plasma.

SUMMARY OF THE INVENTION

Accordingly, the present invention is directed to a flat luminescence lamp and method for manufacturing the same that substantially obviates one or more of problems due to limitations and disadvantages of the related art.

Another object of the present invention is to provide a flat luminescence lamp and method for manufacturing the same in which a problem related to obscure rays is solved by minimizing a width of electrodes of the flat luminescence lamp.

A further object of the present invention is to provide a flat luminescent lamp and method for manufacturing the same in which luminous uniformity is improved by minimizing the number of diffusion sheets, thereby minimizing a thickness and a weight of the lamp.

Additional features and advantages of the invention will be set forth in the description, which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a flat luminescent lamp includes first and second substrates each having a plurality of grooves in sides which the first and second substrates face into each other, first and second electrodes positioned in the grooves, first and second phosphor layers on the first and second substrates including the first and second electrodes, respectively, and a frame for sealing the first and second substrates.

In another aspect of the present invention, a luminescent lamp includes a first substrate having a plurality of grooves therein, a second substrate having a flat surface, first and second electrodes buried in the grooves, a first phosphor layer formed on the first substrate including the first and second electrodes, a second phosphor layer formed on the second substrate, and a frame for sealing the first and second substrates so that the substrates face into each other.

In another aspect of the present invention, a flat luminescent lamp includes first and second substrates each having a plurality of grooves therein, first and second electrodes in the grooves, each electrode having a width narrower than the grooves, phosphor layers on the first and second substrates including the first and second electrodes, and a frame for sealing the first and second substrates so that the substrates face into each other.

In another aspect of the present invention, a flat luminescent lamp includes a first substrate having a plurality of grooves therein, a second substrate having a substantially flat surface, first and second electrodes, each electrode having a width narrower than the grooves, a first phosphor layer on the first substrate including the first and second electrodes, a second phosphor layer on the second substrate, and a frame for sealing the first and second substrates so that the substrates face into each other.

In another aspect of the present invention, a method for manufacturing a flat luminescent lamp, having first and second substrates, includes the steps of forming a plurality of grooves in the first and second substrates, forming an electrode material layer on the first and second substrates including the grooves, flatting a surface of the electrode material layer, forming a phosphor layer on the electrode material layer, and sealing the first and second substrates to face into each other.

In a further aspect of the present invention, a method for manufacturing a flat luminescent lamp, includes the steps of forming a plurality of grooves in first and second substrates, forming an electrode material layer on the first and second substrates including the grooves, forming first and second electrodes in the grooves by selectively removing the electrode material layer, the first and second electrodes having a width narrower than the grooves, forming phosphor layers on the first and second substrates including the first and second electrodes, and sealing the first and second substrates to face into each other.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention.

In the drawings.

DETAILED DESCRIPTION OF THE PREFERRED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Figure 1:
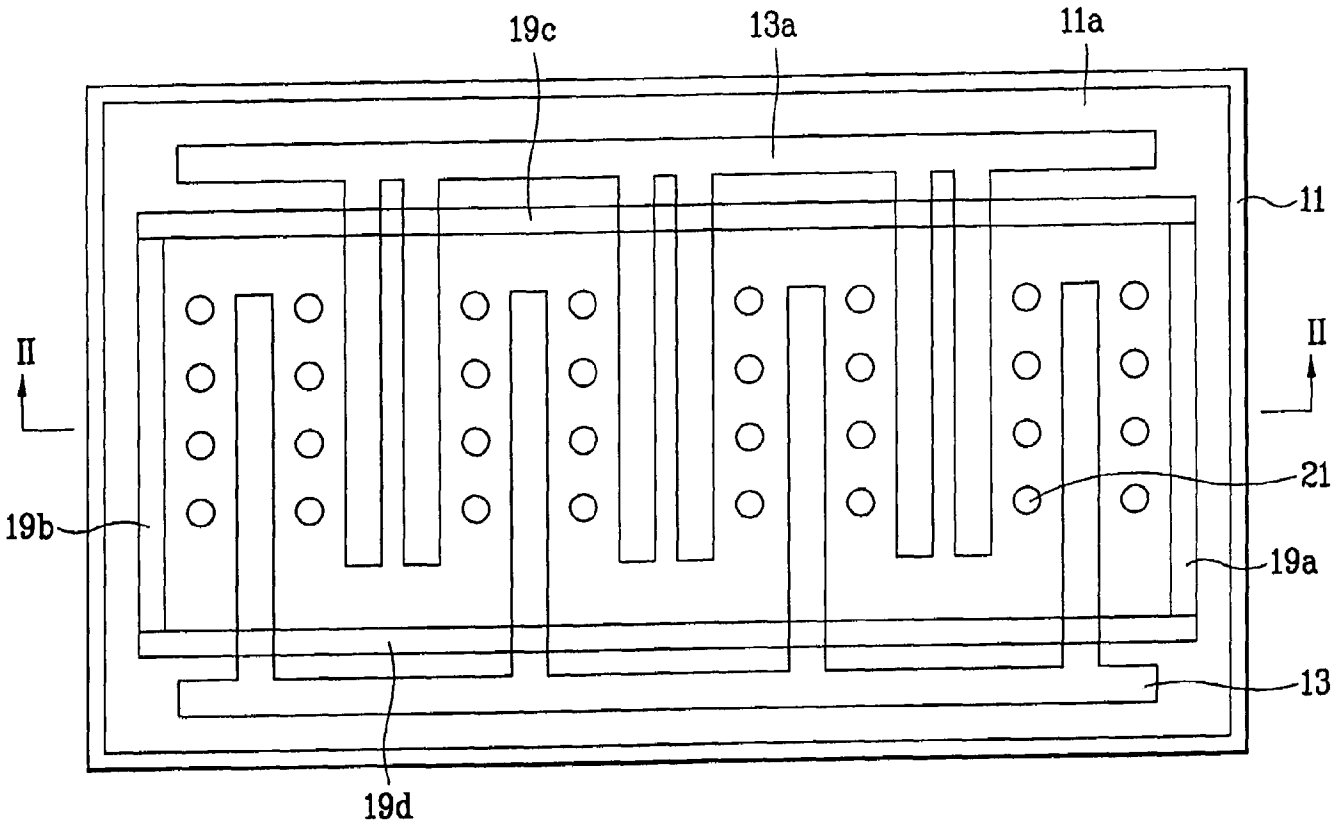
FIG.1 Related Art
FIG. 1 is a plane view illustrating a related art flat luminescent lamp.
Figure 2:
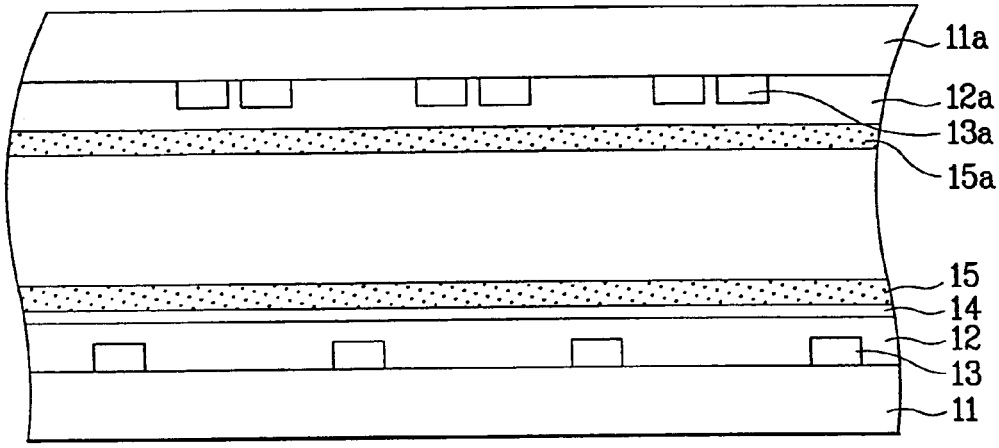
FIG.2 Related Art
FIG. 2 is a cross-sectional view taken along the line II—II of FIG. 1.
Figure 3:
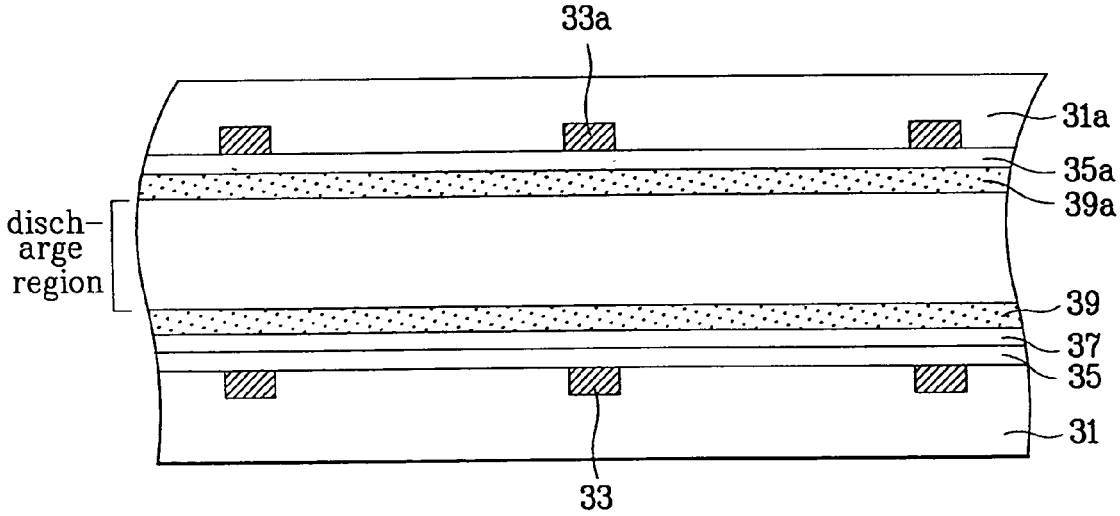
FIG. 3 is a cross-sectional view illustrating a flat luminescent lamp according to a first embodiment of the present invention.

FIG. 3 is a cross-sectional view illustrating a flat luminescent lamp according to a first embodiment of the present invention, and FIGS. 4A to 4D are cross-sectional views illustrating process steps of manufacturing a flat luminescent lamp according to the first embodiment of the present invention.

As shown in FIG. 3, the flat luminescent lamp according to the first embodiment of the present invention includes a first substrate 31 having a plurality of grooves therein and first electrodes 33 buried in the grooves. Further, a first dielectric layer 35 is formed on the first substrate 31 including the first electrodes 33. A reflecting material layer 37 is formed on the first dielectric layer 35 and a first phosphor layer 39 is formed on the reflecting material layer 37.

Similarly, a second substrate 31*a* has a plurality of grooves therein and second electrodes 33*a* are buried in the grooves of the second substrate 31*a*. A second dielectric layer 35*a* is formed on the second substrate 31*a* including the second electrodes 33 and a second phosphor layer 39*a* is formed on the second dielectric layer 35*a*. A frame (not shown) is further formed for sealing the first substrate 31 and the second substrate 31*a*.

Upper surfaces of the first and second electrodes 33 and 33*a* have the same vertical level as the surfaces of the first and second substrates 31 and 31*a*. This can be achieved by flatting an electrode material layer by a chemical mechanical polishing (CMP) process after forming the electrode material layer on the entire surface including the grooves.

The reflecting material layer 37 serves to prevent white light from leaking out to the first substrate 31. The white light is generated by collision of the UV generated by discharge between the first and second electrodes 33 and 33*a* with the phosphor layers.

The first and second electrodes 33 and 33*a* may be formed of a metal with a low specific resistance. The second electrode 33*a* is preferably formed of a transparent conductive material such as indium tin oxide (ITO).

The first electrode 33 and the second electrode 33*a* are connected with an external power source through a lead line (not shown in FIG. 3). A unipolar pulse voltage is supplied to the lead line during discharge.

In the aforementioned flat luminescent lamp, if the voltage is applied to the first and second electrodes 33 and 33*a* through the lead line, a Xe gas forms plasma and emits UV in a discharge space between the first and second electrodes 33 and 33*a*. In this process, the UV comes into collision with the first and second phosphor layers 39 and 39*a* to generate white light, so that the white light is emitted.

In addition, a diffusion sheet (not shown) may further be provided on the rear side of the second substrate 31*a* to emit the generated white light along the entire region of the lamp.

A method of fabricating the flat luminescent lamp according to the first embodiment of the present invention will now be described with reference to FIGS. 4A to 4E.

Figure 4A:
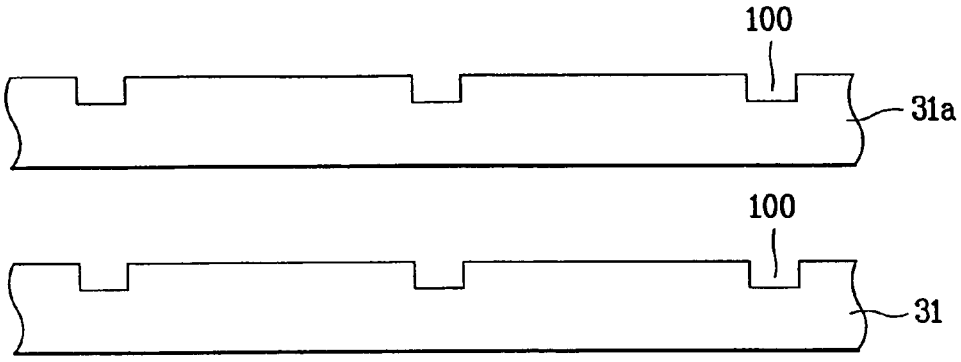
FIGS. 4A to 4E are cross-sectional views illustrating process steps of manufacturing a flat luminescent lamp according to the first embodiment of the present invention.

As shown in FIG. 4A, a plurality of grooves 100 are formed by molding or etching the first and second substrates 31 and 31*a*. The grooves 100 have a stripe shape along the longitudinal direction of the substrates 31 and 31*a*.

Figure 4B:
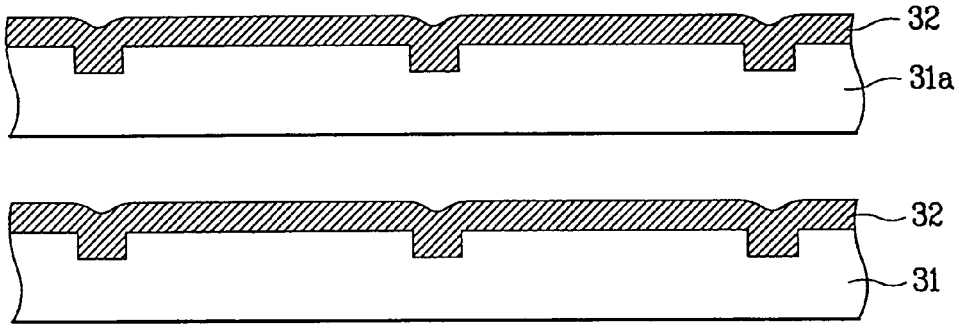
Figure 4C:
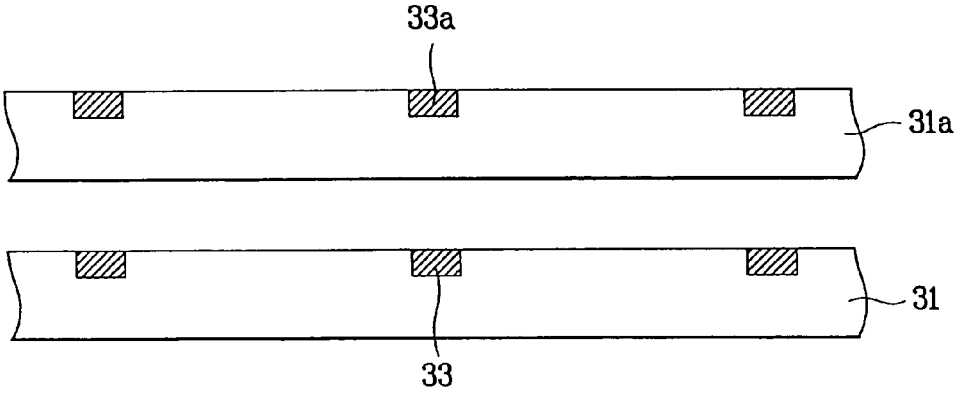

Thereafter, as shown in FIG. 4B, the electrode material layer 32 is formed on the entire surfaces of the first and second substrates 31 and 31*a* including in the grooves 100. As shown in FIG. 4C, the surfaces of the first and second substrates 31 and 31*a* are flatted by a CMP process.

Accordingly, the electrode material layer 32 is buried in the grooves 100 formed in the first and second substrates 31 and 31*a*, so that the first and second electrodes 33 and 33*a* are formed therein. The first electrode 33 serving as a cathode is formed in the grooves 100 of the first substrate 31 while the second electrode 33*a* serving as an anode is formed in the grooves 100 of the second substrate 31*a*.

Figure 4D:
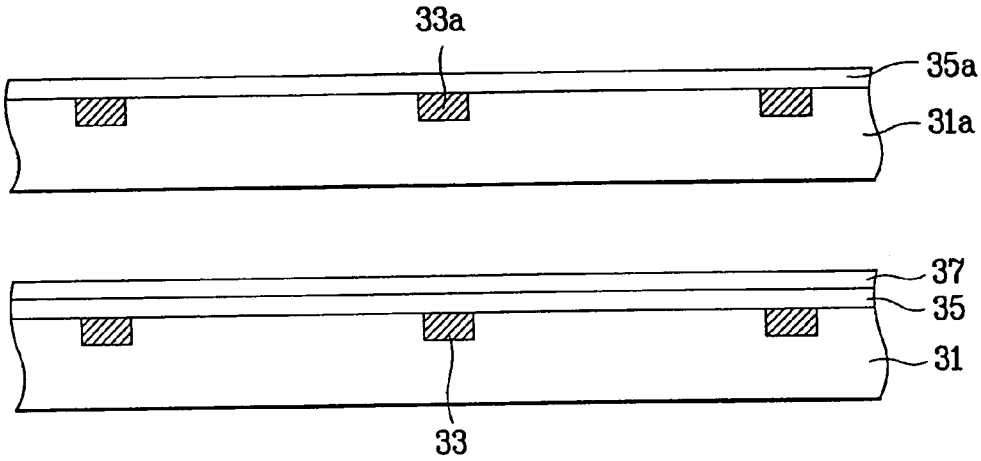

After first and second electrodes 33 and 33*a* are respectively formed on the first and second substrate 31 and 31*a*, as shown in FIG. 4D, the first and second dielectric layers 35 and 35*a* are formed on the respective substrates including the first and second electrodes 33 and 33*a*.

Figure 4E:
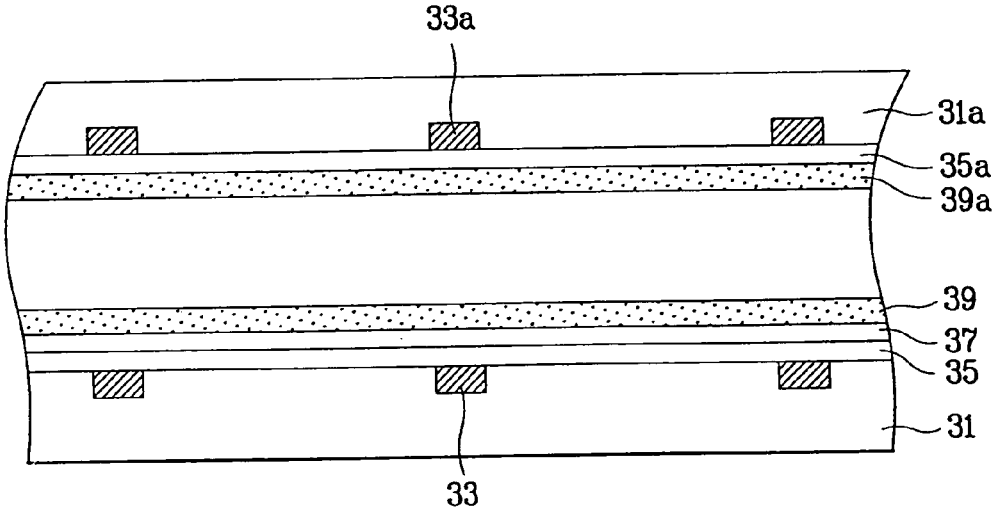

Thereafter, a reflecting material layer 37 is formed on the first dielectric layer 35, which was formed on the first substrate 31. The white light generated during the discharge is prevented from leaking out to the first substrate 31. As shown in FIG. 4E, a first phosphor layer 39 is then formed on the entire surface including the reflecting material layer 37. Similarly, a second phosphor layer 39*a* is formed on the entire surface including the second dielectric layer 35*a*, which was formed on the second substrate 31*a*.

Subsequently, the first substrate 31 and the second substrate 31*a* are bonded to each other and a gas, such as Xe gas, is injected between them through a gas injection hole. The substrates are sealed by forming the frame by soldering using a glass solder. Thus, the process for manufacturing the flat luminescent lamp according to the first embodiment of the present invention is completed.

Figure 5:
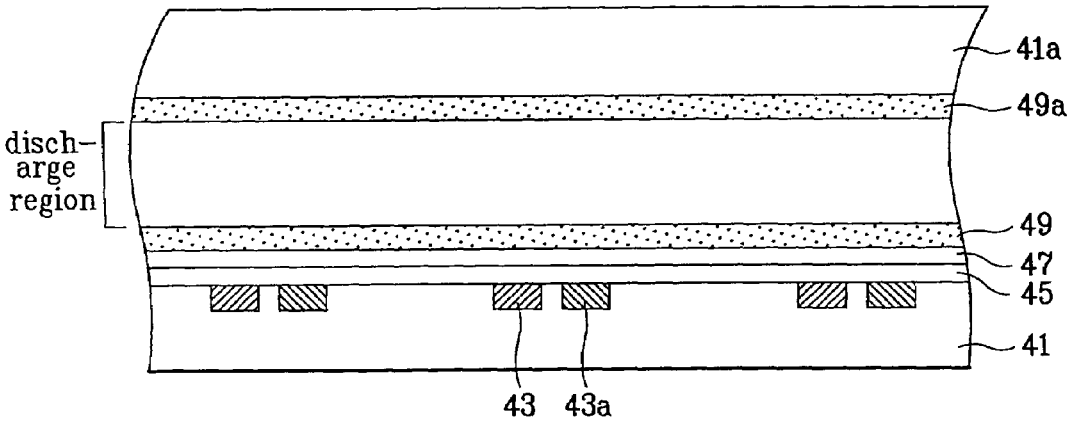
FIG. 5 is a cross-sectional view illustrating a flat luminescent lamp according to a second embodiment of the present invention.

FIG. 5 is a cross-sectional view illustrating a flat luminescent lamp according to a second embodiment of the present invention.

Unlike the first embodiment, in the second embodiment of the present invention, both first and second electrodes 43 and 43*a* are formed on a first substrate 41. Adjacent grooves are formed in the first substrate 41, and first and second electrodes 43 and 43*a* are formed in the respective grooves. Since the second electrode 43*a* is formed in the first substrate 41 in parallel to the first electrode 43, a groove is not necessary in the second substrate 41*a*.

Accordingly, no dielectric layer is required on the second substrate 41*a*, and only a second phosphor layer 49*a* is formed on the second substrate 41*a* to form a discharge space together with the first phosphor layer 49. A reference numeral 45, which is not described, denotes a dielectric layer while a reference numeral 47 denotes a reflecting material layer.

A method for manufacturing a flat luminescent lamp according to the second embodiment of the present invention is similar to the first embodiment of the present invention except for the process step of forming the grooves only in the first substrate 41. Accordingly, its descriptions will be omitted for convenience.

Figure 6:
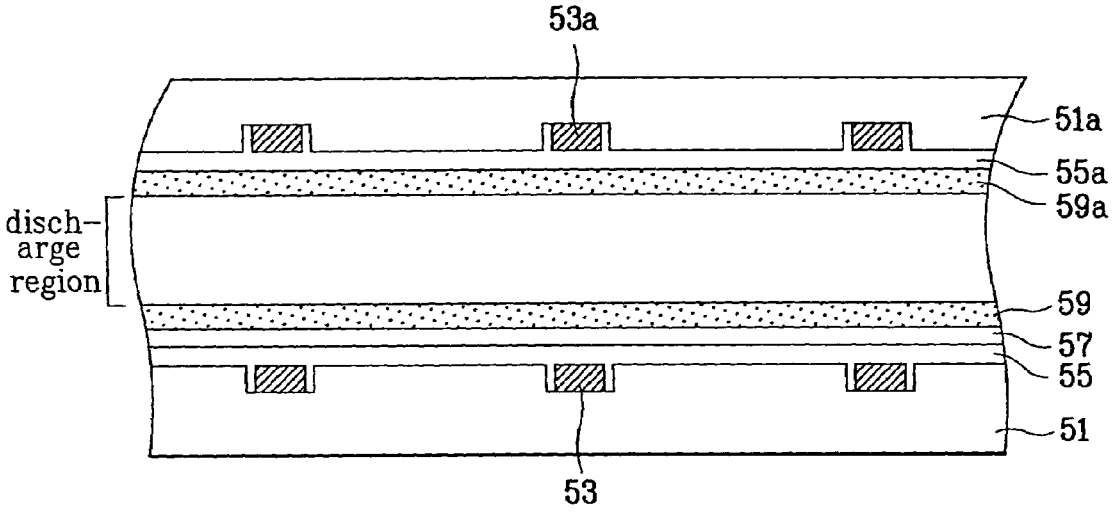
FIG. 6 is a cross-sectional view illustrating a flat luminescent lamp according to a third embodiment of the present invention.

FIG. 6 is a cross-sectional view illustrating a flat luminescent lamp according to a third embodiment of the present invention, and FIGS. 7A to 7E are cross-sectional views illustrating the process steps of manufacturing a flat luminescent lamp according to the third embodiment of the present invention.

As shown in FIG. 6, the flat luminescent lamp according to the third embodiment of the present invention includes first and second substrates 51 and 51*a* provided with a plurality of grooves. First electrodes 53 are buried in the grooves of the first substrate 51. The first electrodes 53 have a width smaller than the grooves of the first substrate 51. Second electrodes 53*a* are formed in the grooves of the second substrate 51*a*. The second electrodes 53*a* have a width smaller than the grooves of the second substrate 51*a*. First and second dielectric layers 55 and 55*a* are respectively formed on the first and second substrates 51 and 51*a* including the first and second electrodes 53 and 53*a*. A reflecting material layer 57 respectively is formed on the first dielectric layer 55, which was formed on the first substrate 51. First and second phosphor layers 59 and 59*a* are formed on the entire surface including the reflecting material layer 57 and the second dielectric layer 55*a*. First and second frames (not shown) are formed for sealing the first substrate 31 and the second substrate 31*a*.

The first and second electrodes 53 and 53*a* are formed by using a photolithography process. The reflecting material layer 57 serves to prevent white light from leaking out to the first substrate 51. The white light is generated by the collision of UV generated by discharge between the first and second electrodes 53 and 53*a* with the phosphor layers.

The first and second electrodes 53 and 53*a* include a metal having a low specific resistance. The second electrode 53*a* is preferably formed of a transparent conductive material. The first electrode 53 and the second electrode 53*a* are respectively connected to an external power source through a lead line, and a unipolar pulse voltage is supplied to the lead line during discharge.

In the aforementioned flat luminescent lamp according to the third embodiment of the present invention, if the voltage is applied to the first and second electrodes 53 and 53*a* through the lead line, an Xe gas forms plasma and emits UV in a discharge space between the first and second electrodes 53 and 53*a*. In this process, the UV comes into collision with the first and second phosphor layers 59 and 59*a* to generate white light, so that the white light is emitted.

Further, a diffusion sheet may be provided on the rear side of the second substrate 51*a* to emit the generated white light along the whole region of the lamp.

A method for manufacturing the flat luminescent lamp according to the third embodiment of the present invention will now be described with reference to FIGS. 7A to 7E.

Figure 7A:
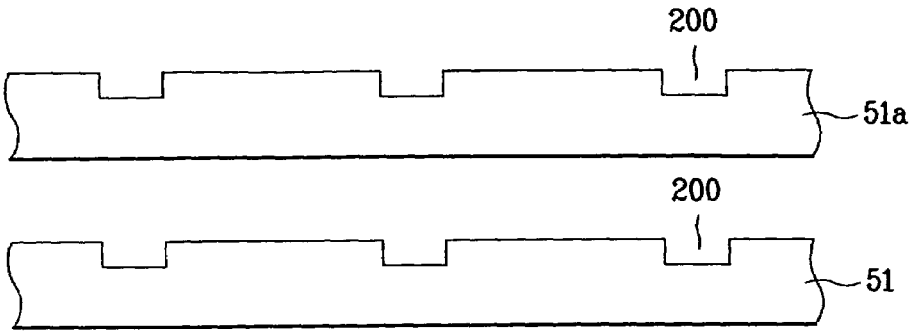
FIGS. 7A to 7E are sectional views illustrating process steps of manufacturing a flat luminescent lamp according to the third embodiment of the present invention.

As shown in FIG. 7A, a plurality of grooves 200 are formed by molding or etching the first and second substrates 51 and 51*a*. The grooves 200 have a stripe shape along the longitudinal direction of the substrates.

Figure 7B:
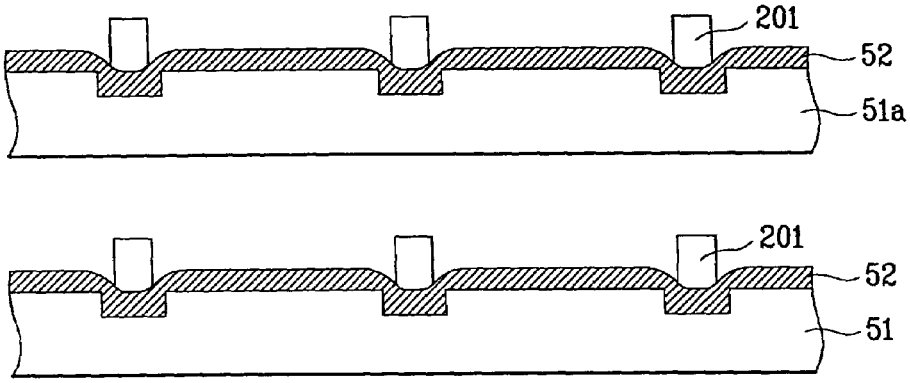
Figure 7C:
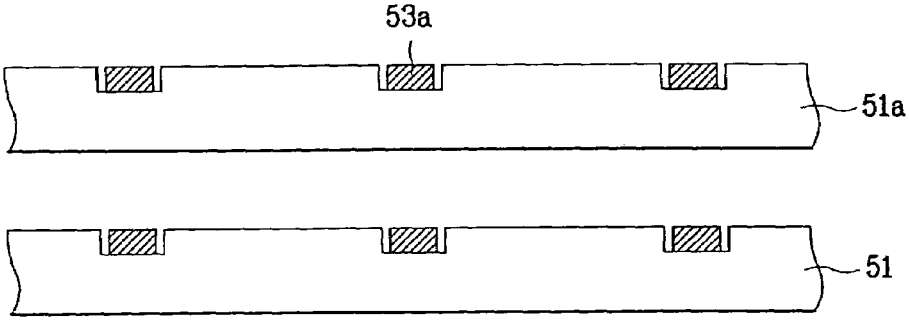

Afterwards, as shown in FIG. 7B, an electrode material layer 52 is formed on the entire surfaces of the first and second substrates 51 and 51*a* including in the grooves 200. Subsequently, a photoresist material 201 is deposited on the electrode material layer 52 and then patterned by exposure and developing processes. As shown in FIG. 7C, the electrode material layer 52 is selectively etched by an etching process using the patterned photoresist material 201 as a mask so that the first and second electrodes 53 and 53*a* are formed in the grooves 200. Both the first and second electrodes 53 and 53*a* have a width smaller than the grooves 200.

At this time, a thickness of the first and second electrodes 53 and 53*a* can be controlled by accurately controlling a deposition thickness of the electrode material layer 52. Also, the first and second electrodes 53 and 53*a* formed in the grooves may have flat surfaces by controlling the width of the grooves.

Figure 7D:
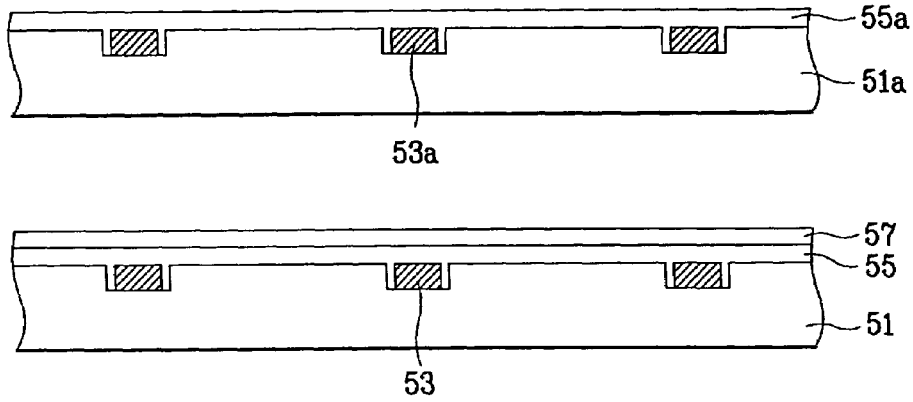

After the first and second electrodes 53 and 53*a* are respectively formed on the first and second substrate 51 and 51*a*, as shown in FIG. 7D, the first and second dielectric layers 55 and 55*a* are formed on the respective substrates including the first and second electrodes 53 and 53*a*.

Figure 7E:
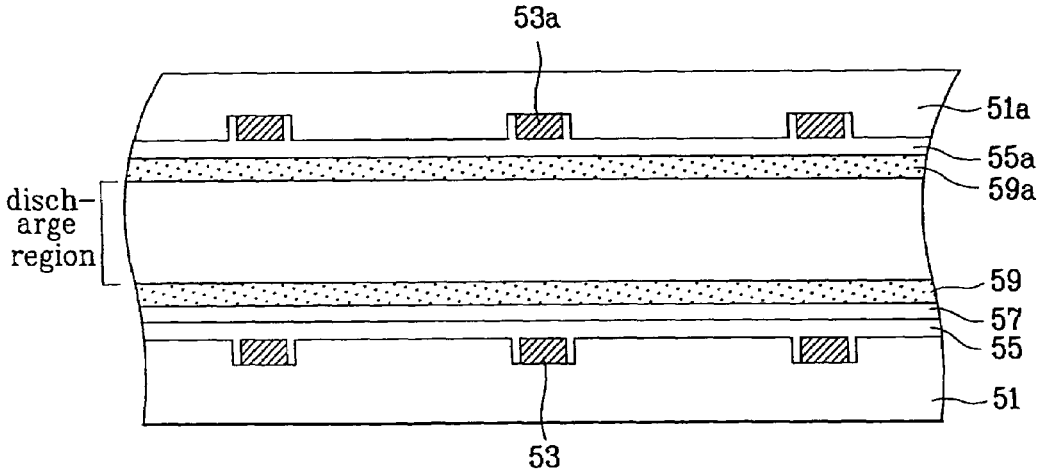

Thereafter, a reflecting material layer 57 is formed on the first dielectric layer 55 formed on the first substrate 51 so that white light generated during discharge is prevented from leaking out to the first substrate 51. As shown in FIG. 7E, a first phosphor layer 59 is then formed on the entire surface including the reflecting material layer 57. Also, a second phosphor layer 59*a* is formed on the entire surface including the second dielectric layer 55*a* formed on the second substrate 51*a*.

Subsequently, the first substrate 51 and the second substrate 51*a* are bonded to each other and a gas, such as Xe gas, is injected between them through a gas injection hole (not shown). Thus, the substrates 51 and 51*a* are sealed by forming frames through soldering using, for example, a glass solder. Finally, a process for manufacturing the flat luminescent lamp according to the third embodiment of the present invention is completed.

Figure 8:
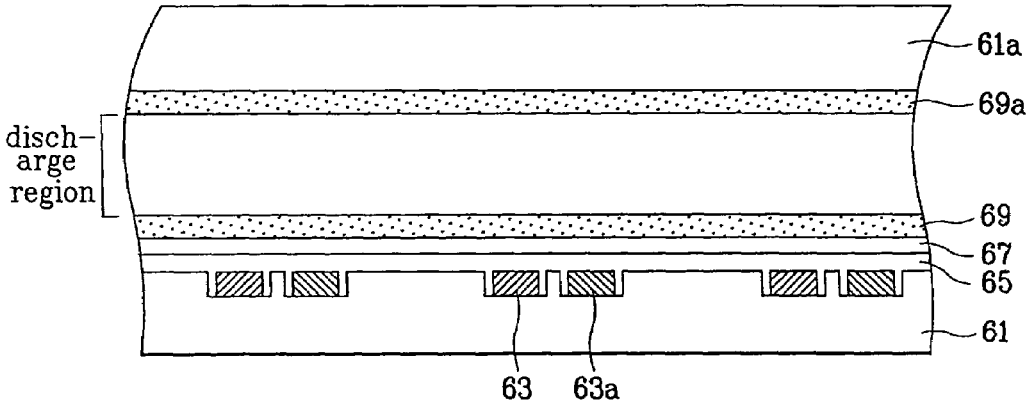
FIG. 8 is a cross-sectional view illustrating a flat luminescent lamp according to a fourth embodiment of the present invention.

FIG. 8 is a cross-sectional view illustrating a flat luminescent lamp according to a fourth embodiment of the present invention. In the fourth embodiment of the present invention, unlike the third embodiment, both first and second electrodes 63 and 63*a* are formed on a single substrate.

More specifically, the first and second electrodes 63 and 63*a* are respectively formed in adjacent grooves formed in a first substrate 61. A dielectric layer 65 is formed on the entire surface including the first and second electrodes 63 and 63*a*. A reflecting material layer 67 and a first phosphor layer 69 are sequentially formed on the dielectric layer 65.

Since the first and second electrodes 63 and 63*a* are formed in the first substrate 61, no dielectric layer is necessary in the second substrate 61*a*. A second phosphor layer 69*a* is only formed in the second substrate 61*a* to form a discharge space together with the first phosphor layer 69.

A method of manufacturing a flat luminescent lamp according to the fourth embodiment of the present invention is similar to the third embodiment except for the process step of forming the grooves for the first and second electrodes only in the first substrate. Accordingly, other detailed descriptions will be omitted for simplicity.

As described above, the flat luminescent device and the method for manufacturing the same according to the present invention have the following advantages.

Since the flat luminescent lamp is formed by a CMP or photolithography process, a width of the electrode is reduced by an order of $\mu$m. Accordingly, the problem related to obscure rays due to the broad width of the electrode is resolved in the present invention. As a result, the number of diffusion sheets, which will be formed on the lamp, is reduced, thereby minimizing thickness and weight of the lamp as well as manufacturing cost.

It will be apparent to those skilled in the art that various modifications and variations can be made in the flat luminescence lamp and method for manufacturing the same of the present invention without departing from the spirit or scope of the inventions. Thus, it is intended that the present invention covers the modifications and variations of this invention provided they come within the scope of the appended claims and their equivalents.

What is claimed is:

1. A method for manufacturing a flat luminescent lamp, comprising the steps of:

forming a plurality of grooves in first and second substrates;

forming an electrode material layer on the first and second substrates including the grooves;

forming first and second electrodes in the grooves by selectively removing the electrode material layer, the first and second electrodes having a width narrower than the grooves such that a gap is defined between each of the electrodes and a respective one of the grooves;

forming phosphor layers on the first and second substrates including the first and second electrodes; and sealing the first and second substrates with one another.

2. The method of claim 1, wherein the step of forming the first and second electrodes includes the steps of:

depositing a photoresist material on the electrode material layer;

patterning the photoresist material using exposure and developing processes; and etching the electrode material layer using the patterned photoresist material as a mask.

3. The method of claim 1, wherein the step of forming first and second electrodes is performed by a chemical mechanical polishing process.

4. The method of claim 1, further comprising the step of forming a dielectric layer after the step of forming first and second electrodes.

5. The method of claim 4, further comprising the step of forming a reflecting material layer on the dielectric layer.

6. The method of claim 1, further comprising the step of injecting a phosphor gas between the first and second substrates through a gas injection hole before the step of sealing the first and second substrates.

7. A method for manufacturing a flat luminescent lamp, comprising the steps of:

forming a plurality of grooves in a first substrate;

forming an electrode material layer on the first substrate including the grooves;

forming first and second electrodes in the grooves by selectively removing the electrode material layer, the first and second electrodes having a width narrower than the grooves such that a gap is defined between each of the electrodes and a respective one of the grooves;

forming phosphor layers on the first substrate including the first and second electrodes and a second substrate; and sealing the first and second substrates with one another.

8. The method of claim 7, wherein the step of forming the first and second electrodes includes the steps of:

depositing a photoresist material on the electrode material layer;

patterning the photoresist material using exposure and developing processes; and etching the electrode material layer using the patterned photoresist material as a mask.

9. The method of claim 7, wherein the step of forming first and second electrodes is performed by a chemical mechanical polishing process.

10. The method of claim 7, further comprising the step of forming a dielectric layer after the step of forming first and second electrodes.

11. The method of claim 10, further comprising the step of forming a reflecting material layer on the dielectric layer.

12. The method of claim 7, further comprising the step of injecting a phosphor gas between the first and second substrates through a gas injection hole before the step of sealing the first and second substrates.

* * * * *